US007444114B2

(12) United States Patent
Tanimoto

(10) Patent No.: US 7,444,114 B2
(45) Date of Patent: Oct. 28, 2008

(54) IMAGE FORMING APPARATUS AND IMAGE FORMING METHOD

(75) Inventor: Takeshi Tanimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 469 days.

(21) Appl. No.: 11/209,855

(22) Filed: Aug. 24, 2005

(65) Prior Publication Data

US 2006/0204299 A1 Sep. 14, 2006

(30) Foreign Application Priority Data

Mar. 11, 2005 (JP) ..... 2005-069868

(51) Int. Cl.
*G03G 15/00* (2006.01)

(52) U.S. Cl. ..... 399/396; 399/394

(58) Field of Classification Search ..... 399/396, 399/394

See application file for complete search history.

(56) References Cited

U.S. PATENT DOCUMENTS 4,419,003 A * 12/1983 Fujie et al. ..... 399/322
4,478,508 A * 10/1984 Kato et al. ..... 399/384
6,000,595 A * 12/1999 Crowley et al. ..... 226/15
6,285,854 B1 * 9/2001 Obata et al. ..... 399/384
6,321,650 B1 * 11/2001 Ogawa et al. ..... 101/227
6,684,051 B2 * 1/2004 Miyamoto et al. ..... 399/384
6,718,150 B2 * 4/2004 Matsuduki ..... 399/194
6,799,507 B2 * 10/2004 Ohba et al. ..... 101/228
2004/0140387 A1 * 7/2004 Ishida et al. ..... 242/417.3
2004/0175213 A1 * 9/2004 Matsuzuki et al. ..... 399/384

FOREIGN PATENT DOCUMENTS

JP 2004-155533 6/2004

* cited by examiner

*Primary Examiner*—Anthony H. Nguyen
(74) *Attorney, Agent, or Firm*—Morgan Lewis & Bockius LLP

(57) ABSTRACT

An image forming apparatus that conveys a long belt-like recording sheet on a conveyance path and forms an image on the recording sheet when the recording sheet passes through an image forming section, the image forming apparatus comprising: a recording medium drive component that is disposed downstream of the image forming section in a conveyance direction on the conveyance path and conveys the recording medium; a tension imparting component that is disposed upstream of the image forming section in the conveyance direction on the conveyance path and imparts tension to the recording medium; and a control unit which, when a printing operation for forming an image is started, drives the tension imparting component to impart tension to the recording medium between the recording medium drive component and the tension imparting component, and starts the recording medium conveyance operation.

12 Claims, 12 Drawing Sheets

IMAGE FORMING APPARATUS AND IMAGE FORMING METHOD

CROSS-REFERENCE TO RELATED APPLICATION

This application claims priority under 35 USC 119 from Japanese Patent Application No. 2005-69868, the disclosure of which is incorporated by reference herein.

BACKGROUND OF THE INVENTION

1. Field of the Invention

The present invention relates to an image forming apparatus and an image forming method that form an image while conveying a long band-like sheet-like recording medium.

2. Description of the Related Art

In recent years, in order to accommodate the demand to diversify and increase the volume of information processing, printers serving as image forming apparatus have been used which enable high-speed processing by adopting an electrophotographic image-making process and using continuous paper (continuous sheet paper) as the recording medium (transfer medium).

Among such high-speed printers, there is a printer that uses, as the recording medium, continuous paper in which feed holes (called "pin holes" below) are formed at equidistant intervals continuously in the feeding direction in both edge portions of the paper. The printer is disposed with a tractor including pins that fit into the pin holes in the continuous paper, and is configured to convey the continuous paper by rotating the tractor. The continuous paper is retained as a result of the pins of the tractor fitting into the pin holes, whereby the continuous paper is prevented from becoming slack on the conveyance path.

The portions at both edges of the continuous paper and in which the pin holes are formed at equidistant intervals are used simply for the tractor of the printer to convey the continuous paper. Thus, both edge portions become unnecessary after the continuous paper has been printed, and are cut off and discarded in a later processing step. Consequently, the demand is rising for an image forming apparatus that can convey, as the recording medium, painless continuous paper, in which pin holes are not disposed, in order to prevent both edge portions of the continuous paper from becoming useless and to cut back on the processing cost for cutting off both edges of the continuous paper.

Also, in view of the characteristics of the conveyance motor that is driven in order to convey the paper, a certain amount of time is needed in such high-speed printers in order to bring the conveyance motor up to a constant speed when printing is started, or to stop the conveyance motor from the constant speed when printing is stopped. Consequently, it is common for such high-speed printers to conduct control to bring the conveyance motor up to a constant speed while the continuous paper is conveyed a certain length X and, when printing is stopped, to stop the conveyance motor at the point in time when the continuous paper has been conveyed a certain length Y.

Here, it is desirable for such high-speed printers to be capable of continuous printing to ensure that when the printer conducts intermittent printing or resumes printing after printing has been stopped, the continuous paper is conveyed in the opposite direction by an amount corresponding to the length of X+Y when printing is stopped so that there is no useless white paper (blank spaces) of the lengths X+Y arising due to positional displacement of the continuous paper, so that it is difficult for useless white paper to arise.

Thus, image forming apparatus in the related art which can convey painless continuous paper as the recording medium are configured so that continuous paper having no pin holes is supplied from a paper supply section and nipped by a drive roller pair. The drive roller pair is rotated while nipping the continuous paper, whereby the continuous paper is frictionally conveyed counter to the braking force of a tension imparting component for taking up the slack. An oblique roller, which is disposed in a paper position regulating section disposed on the conveyance path and is arranged obliquely with respect to an axis orthogonal to the paper conveyance direction, rolling contacts the paper, whereby one side edge of the continuous paper is made to glidingly contact an edge guide, without imparting the braking force, and the continuous paper is positioned. Then, the continuous paper is conveyed into a printing section disposed on the conveyance path between the oblique roller and the drive roller pair, and printing is conducted.

Moreover, image forming apparatus in the related art which can convey painless continuous paper as the recording medium include a buffer roller disposed between the printing section and the oblique roller of the paper position regulating section. The buffer roller is driven by a drive component such as a motor to contact the surface of, and absorb the slack in, the continuous paper in accordance with a back feed amount where the drive roller pair for frictional conveyance is reversely rotated to convey the continuous paper in the opposite direction when printing is stopped.

The buffer roller configures a buffer component that is driven by the drive component so as to separate from the surface of the continuous paper while the continuous paper is being printed by the printing section. When printing is stopped or started, the buffer component is driven by the drive component to contact, push, and separate the surface of the continuous paper from the linear conveyance path at the time of printing, to ensure that the recording paper does not become slack (e.g., see Japanese Patent Application Publication (JP-A) No. 2004-155533).

Image forming apparatus in the related art which can convey painless continuous paper as the recording medium have the problem that they include plural mechanisms because the recording paper buffer component is disposed between the oblique roller and the printing section. Also, because the buffer component is disposed between the oblique roller and the printing unit, there are problems in that there are variations in the position of the recording paper that is positioned as a result of the oblique roller causing the recording paper to glidingly contact the edge guide, the behavior of the paper at the time printing starts becomes unstable, and the printing precision at the start of printing deteriorates in comparison to when printing is conducted on paper including pin holes (sprocket-fed paper).

SUMMARY OF THE INVENTION

The present invention has been made of the above circumstances and provides an image forming apparatus and an image forming method.

A first aspect of the invention provides an image forming apparatus that conveys a long belt-like recording sheet on a conveyance path and forms an image on the recording sheet when the recording sheet passes through an image forming section, the image forming apparatus comprising: a recording medium drive component that is disposed downstream of the image forming section in a conveyance direction on the conveyance path and conveys the recording medium; a tension imparting component that is disposed upstream of the image forming section in the conveyance direction on the conveyance path and imparts tension to the recording medium; and a control unit which, when a printing operation for forming an image is started, drives the tension imparting component to impart tension to the recording medium between the recording medium drive component and the tension imparting component, and starts the recording medium conveyance operation.

A second aspect of the invention provides a method of forming an image on a long band-like sheet-like recording medium using an image forming apparatus, the image forming apparatus including an image forming section that forms an image on the recording medium, a recording medium drive component that is disposed downstream of the image forming section and conveys the recording medium, a tension imparting component that is disposed upstream of the image forming section and imparts tension to the recording medium, the image forming method comprising: a tension imparting step to impart tension to the recording medium between the recording medium drive component and the tension imparting component by the tension imparting component when the image forming section starts forming the image on the recording medium; conveying step to convey the recording medium.

BRIEF DESCRIPTION OF THE DRAWINGS

A preferred embodiment of the present invention will be described in detail based on the following figures, wherein.

DETAILED DESCRIPTION OF THE INVENTION

Figure 1:
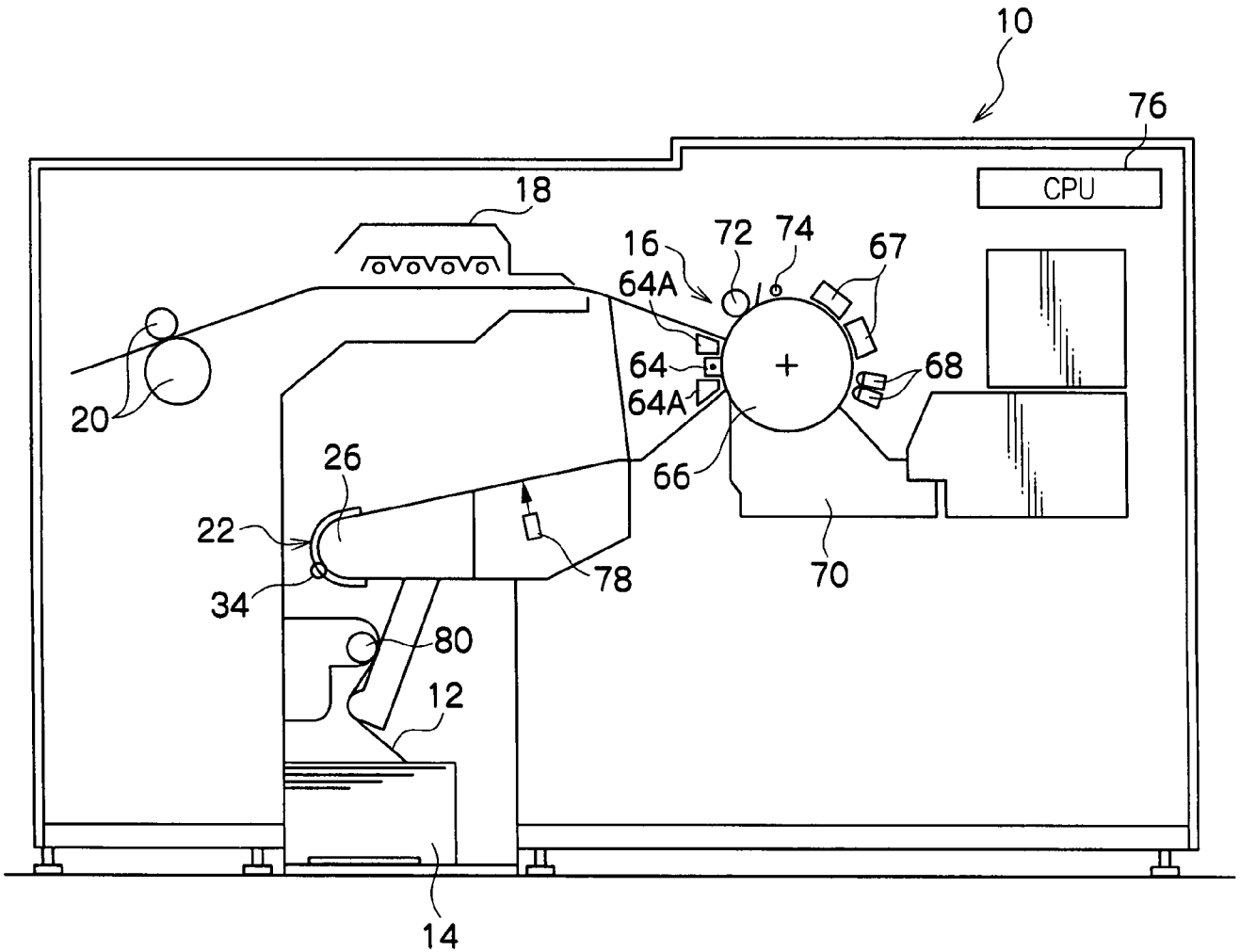
FIG. 1 is a schematic configurable view showing an image forming apparatus pertaining to the embodiment of the invention.

An image forming apparatus 10 pertaining to an embodiment of the invention will now be described with reference to FIGS. 1 to 12. As shown in the schematic configurable view of FIG. 1, the image forming apparatus (printer) 10 is configured to successively form, in accordance with an image formation process (image-making process), images on continuous paper 12 while conveying the continuous paper 12 on a conveyance path. The continuous paper 12 is a long band-like sheet-like recording medium in which pin holes are not formed, and is pulled out from a supply unit 14 disposed in a lower portion of the body of the image forming apparatus 10.

The image forming apparatus 10 includes an image forming section 16 and a fixing device 18. The image forming section 16 is a printing section (transfer section) configured to transfer a toner image. The fixing device 18 fixes, to a fixed image, the toner image of a transfer medium in a flash-lamp format (non-contact fixing format).

The image forming apparatus 10 also includes drive rollers 20, which serve as a recording medium drive component that is rotated/driven by a motor, and an alignment section 22. The drive rollers 22 move in a state where they nip the continuous paper 12, and frictionally convey the continuous paper 12. Thus, when the continuous paper 12 is pulled out from the supply unit 14 and passes through the alignment section 22, the position of the continuous paper 12 is aligned in the width direction. Thereafter, the continuous paper 12 is conveyed on the conveyance path through the image forming section 16 and the fixing device 18 to the outside of the apparatus.

Figure 2:
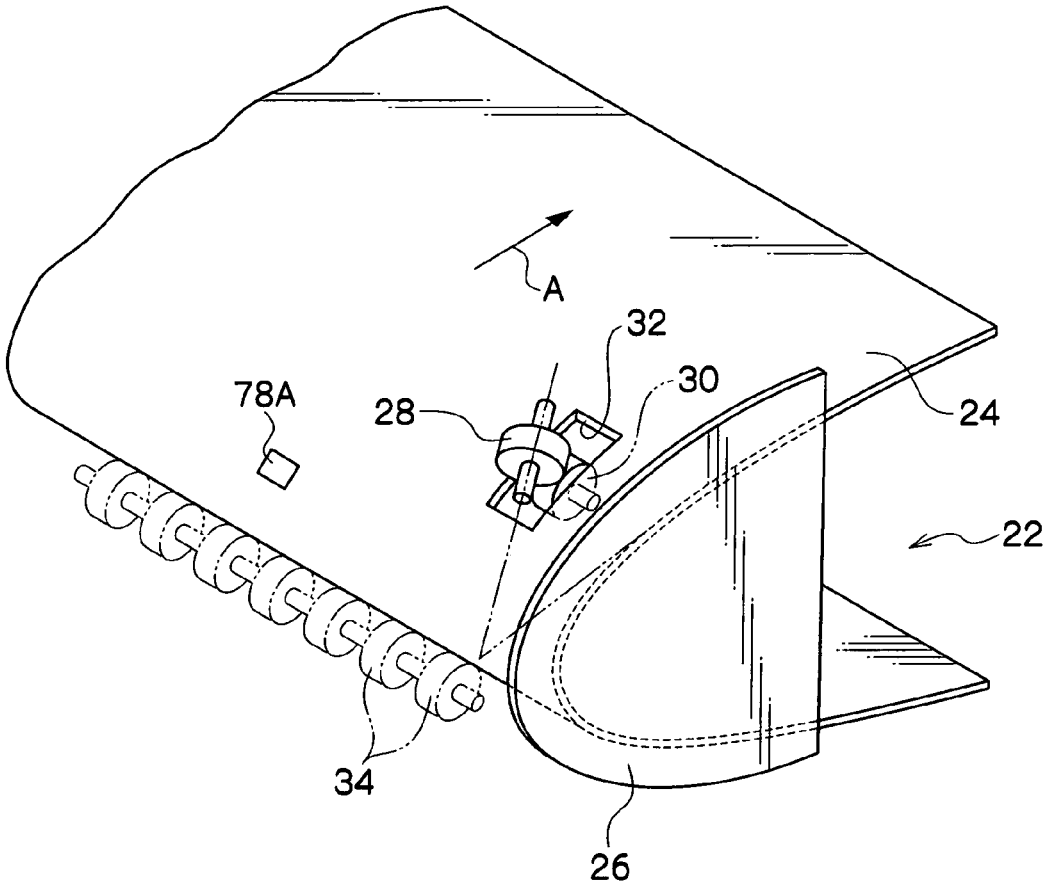
FIG. 2 is a schematic perspective view showing an alignment section for positioning and conveying continuous paper into an image forming section in the image forming apparatus pertaining to the embodiment of the invention.
Figure 3:
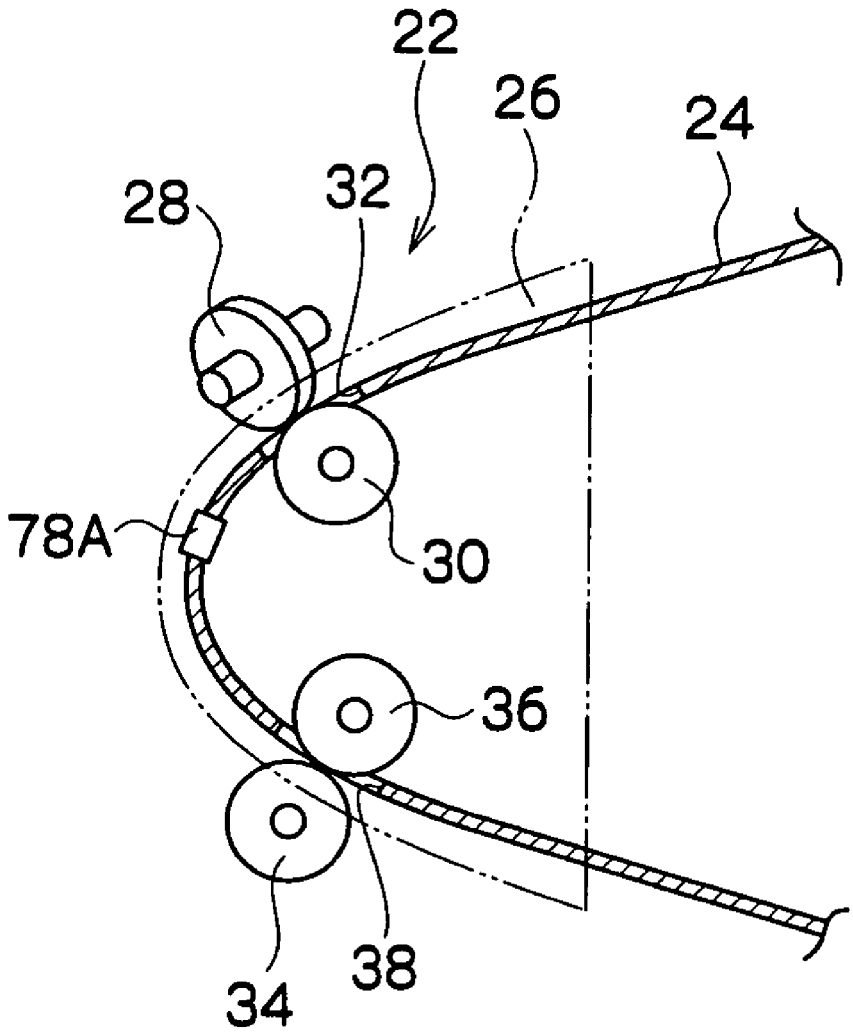
FIG. 3 is a longitudinal cross-sectional view showing the alignment section for positioning and conveying the continuous paper into the image forming section in the image forming apparatus pertaining to the embodiment of the invention.

In the image forming apparatus 10, as shown in FIGS. 2 and 3, the alignment section 22 is disposed in a portion of the conveyance path set in a sideways "U" shape upstream of the image forming section 16 in the conveyance direction.

The alignment section 22 includes a guide plate 24, which sets the conveyance path in the sideways "U" shape, and an edge guide 26, which is disposed at one end of the guide plate 24 as a positioning reference. The edge guide 26 is formed by a flat plate that is configured in a flange shape extending, to a predetermined height at a right angle with respect to the surface of the guide plate 24, from the curved end serving as the positioning reference.

The alignment section 22 also includes an oblique roller 28 and back feed rollers 34. The oblique roller 28 is configured by an urethane rubber roller and disposed at a predetermined position near the edge guide 26 downstream of the edge guide 26 in the conveyance direction in order to maintain and position the continuous paper 12 in a state where the oblique roller 28 causes the conveyed continuous paper 12 (shown in FIG. 4) to glidingly contact the edge guide 26. The back feed rollers 34 are disposed upstream of the oblique roller 28 in the conveyance direction, or in part of the alignment section 22, or upstream of the alignment section 22 in the conveyance direction.

By arranging and disposing these members in this manner, the conveyed continuous paper 12 can be stably conveyed into the image forming section 16 in a state where the continuous paper 12 is positioned in a skew direction by the oblique roller 28 or the alignment section 22. The reason for this is, when the back feed rollers 34 are disposed between the oblique roller 28 or the alignment section 22 and the image forming section 16, the back feed rollers 34 can be prevented from rolling contacting the continuous paper 12 and causing the continuous paper 12 to move in a skew direction to give rise to error.

Figure 4:
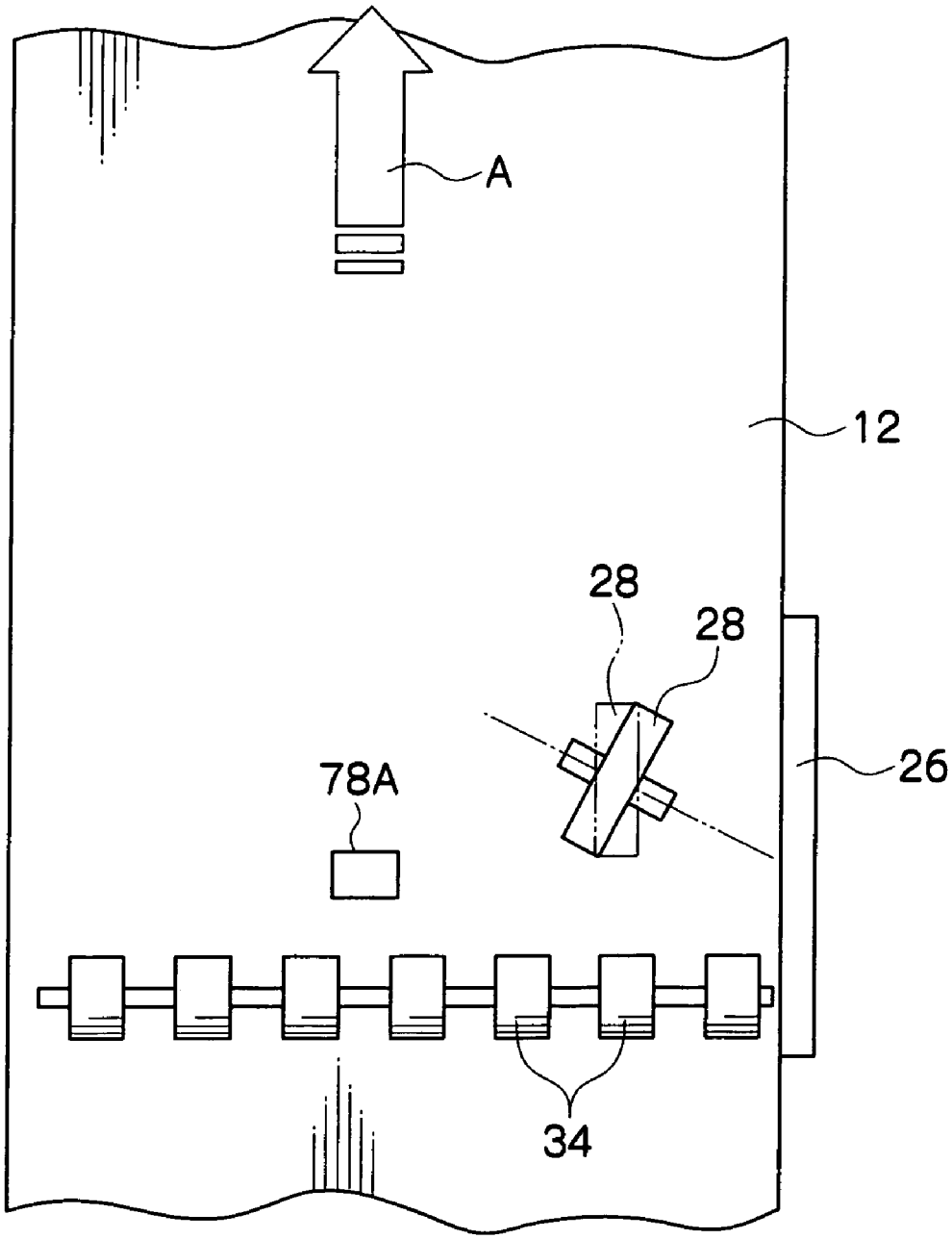
FIG. 4 is a descriptive view showing, in developed plan view, the alignment section for positioning and conveying the continuous paper into the image forming section in the image forming apparatus pertaining to the embodiment of the invention.

The back feed rollers 34 double as a tension imparting component (tension generating component). As shown in FIGS. 2 and 4, the back feed rollers 34 comprise a roller group in which plural small rollers are arranged in a line at predetermined intervals. As shown in FIG. 3, the back feed rollers 34 form pairs with opposition rollers 36 that have the same shapes as those of the back feed rollers 34, whereby the back feed rollers 34 and the opposition rollers 36 nip the continuous paper 12. When the back feed rollers 34 are rotated/driven, the back feed rollers 36 convey the continuous paper 12 in the opposite direction of the conveyance direction A for image formation shown in FIG. 4.

Rectangular openings 38 (shown in FIG. 3) are formed in the portions of the guide plate 24 at which the pairs of the small rollers comprising the back feed rollers 34 and the opposition rollers 36 are positioned. The opposition rollers 36 are disposed at the inner sides of the openings 38. The back feed rollers 34 and the opposition rollers 36 are configured to rotate in a state where the continuous paper 12 is nipped between the back feed rollers 34 and the opposition rollers 36.

The back feed rollers 34 and the opposition rollers 36 always mutually press against each other with appropriate pressure. When the continuous paper 12 is conveyed in the conveyance direction A, appropriate tension is imparted to the continuous paper 12 as a result of the rollers sliding in accompaniment with or following the movement of the paper. The rotational speed of the back feed rollers 34 is greater than the reverse rotational speed of the drive rollers 20, so that when the continuous paper 12 is backed, the rollers rotate while sliding on the paper and appropriate tension is applied to the paper.

A torque limiter or a component that adjusts the friction coefficient of the surfaces of the back feed rollers 34 is used to ensure that the back feed rollers 34 and the opposition rollers 36 do not apply tension equal to or greater than a predetermined value to the continuous paper 12 when the continuous paper 12 is nipped by and conveyed between the back feed rollers 34 and the opposition rollers 36. Moreover, by exciting and stopping an AC servo motor connected via a gear mechanism to rotate/drive the back feed rollers 34, the reverse rotation of the back feed rollers 34 is inhibited and the tension in the continuous paper 12 is maintained to prevent the continuous paper 12 from becoming slack.

As shown in FIGS. 2 to 4, the oblique roller 28 disposed in the alignment section 22 rolling contacts the surface of the continuous paper 12 being conveyed in the conveyance direction, and urges the continuous paper 12 so that one end edge of the continuous paper 12 always glidingly contacts the surface of the guide plate 24. Thus, the oblique roller 28 is disposed so that its rotational axis forms a predetermined narrow angle with the surface of the guide plate 24.

In the present embodiment, the oblique roller 28 is disposed so that its rotational axis forms a narrow angle of 30 degrees or less with the surface of the guide plate 24, but the narrow angle may be appropriately set in accordance with the properties of the continuous paper 12. For instance, when conveying continuous paper 12 that is thin, the narrow angle may be set to 15 degrees or less.

The oblique roller 28 forms a pair with a nip roller 30 disposed facing the oblique roller 28 in order to weaken the frictional resistance with respect to the continuous paper 12. For this reason, a rectangular opening 32 is formed in the portion of the guide plate 24 at which the oblique roller 28 is disposed. The nip roller 30 is disposed at the inner side of the opening 32. The oblique roller 28 and the nip roller 30 rotate in a state where the continuous paper 12 is nipped between the oblique roller 28 and the nip roller 30. The rotational axis of the nip roller 30 is set in the direction orthogonal to the conveyance direction so that the track of movement of its outer peripheral surface is along the conveyance direction.

The oblique roller 28 rolling contacts the continuous paper 12 while the continuous paper 12 is nipped between the oblique roller 28 and the surface of the guide plate 28. When the continuous paper 12 is conveyed in the forward direction toward the image forming section 16, the oblique roller 28 causes one end edge of the continuous paper 12 to always glidingly contact the surface of the edge guide 26.

When the back feed rollers 34 are driven and the continuous paper 12 is backed in the opposite direction of the conveyance direction, the oblique roller 28 urges the continuous paper 12 to separate from the guide plate 24 to prevent the behavior of the backed continuous paper 12 from becoming unstable. Thus, the oblique roller 28 is configured so that its direction can be changed by a direction changing component from being oblique in the conveyance direction (represented by the solid lines in FIG. 4) to being disposed along the conveyance direction (represented by the hypothetical lines shown in FIG. 4). The oblique roller 28 may also be configured to rise and dissociate from the top of the continuous paper 12.

Next, a component for improving printing precision by causing the continuous paper 12 to be stably conveyed on the conveyance path when printed is started by the image forming section 16, which is a printing section (transfer section), with respect to the continuous paper 12, which is a continuous recording medium in which pin holes are not formed, will be described.

In the component for improving printing precision, a control unit (e.g., a CPU) 76 disposed inside the image forming apparatus 10 as shown in FIG. 1 conducts automatic control for improving the printing precision by the image forming section 16 by causing the continuous paper 12 to be stably conveyed on the conveyance path.

Figure 6:
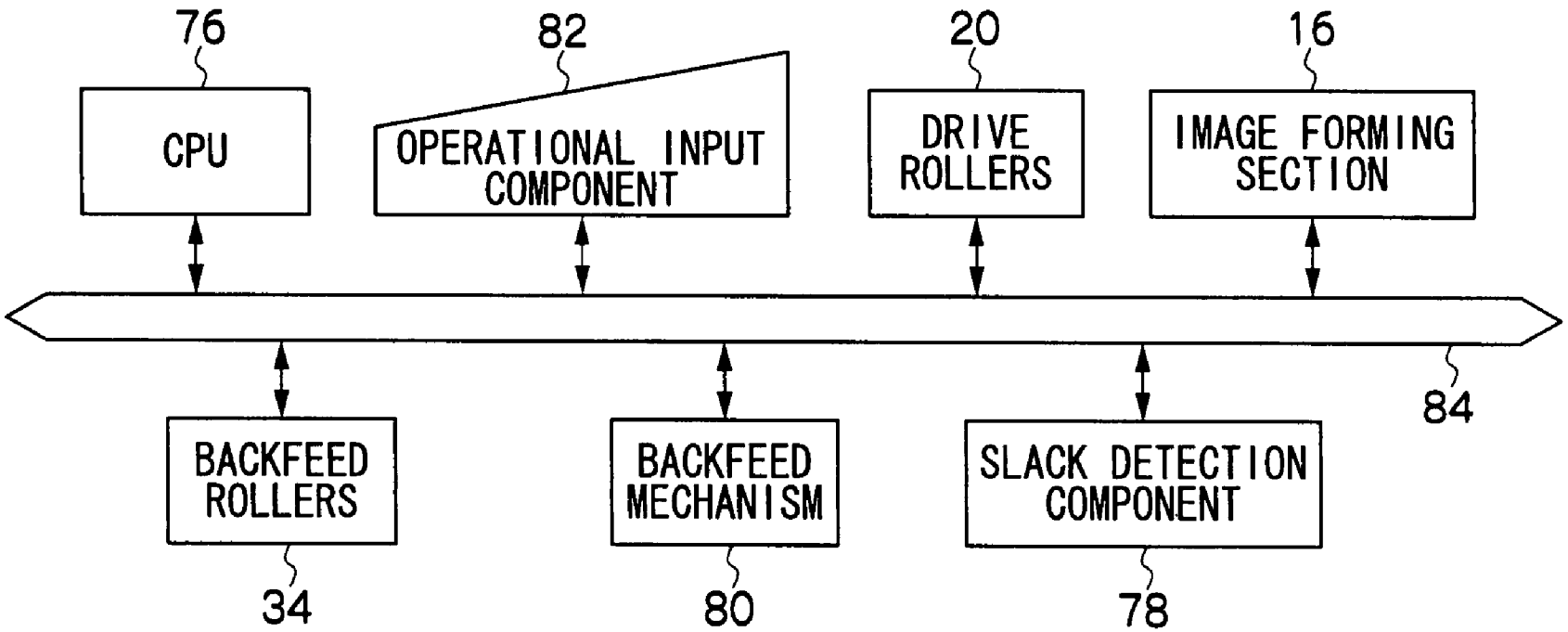
FIG. 6 is a block diagram showing the schematic configuration of a control component pertaining to a component for improving printing precision in the image forming apparatus pertaining to the embodiment of the invention.

As shown in FIG. 6, the component for improving printing precision is configured by at least an operational input component 82, the drive rollers 20, the image forming section 16, the back feed rollers 34, a back feed mechanism 80, and a slack detection component 78 being connected via a bus 84 to the control unit 76.

The operational input component 82 is configured to allow a user to use an operational panel or the like to input commands for starting, stopping, or resuming the image formation operation with respect to the continuous paper 12.

The back feed mechanism 80 doubles as a tension imparting component (tension generating component), is disposed at a position between the supply unit 14 and the alignment section 22 on the conveyance path of the continuous paper 12, and reversely conveys the continuous paper 12, which has been conveyed downstream in the conveyance direction by the drive rollers 20, upstream in the conveyance direction. A torque limiter, or a component that adjusts the friction coefficient of the surfaces of the rollers rolling contacting the continuous paper 12 and causes the rollers to idle so that they slide on the continuous paper 12, is used to ensure that the back feed mechanism 80 does not apply tension equal to or greater than a predetermined value to the continuous paper 12 when the continuous paper 12 is conveyed. Moreover, by exciting and stopping an AC servo motor connected via a gear mechanism to rotate/drive the rollers, the reverse rotation of the rollers is inhibited and the tension in the continuous paper 12 is maintained to prevent the continuous paper 12 from becoming slack.

The back feed mechanism 80 is disposed upstream of the oblique roller 28 in the conveyance direction, or in part of the alignment section 22, or upstream of the alignment section 22 in the conveyance direction.

By arranging and disposing these members in this manner, the conveyed continuous paper 12 can be stably conveyed into the image forming section 16 in a state where the continuous paper 12 is positioned in a skew direction by the oblique roller 28 or the alignment section 22. The reason for this is, when the back feed mechanism 80 is disposed between the oblique roller 28 or the alignment section 22 and the image forming section 16, the back feed mechanism 80 can be prevented from rolling contacting the continuous paper 12 and causing the continuous paper 12 to move in a skew direction to give rise to error.

The component for improving printing precision may be configured by concomitantly using the back feed mechanism 80 and the back feed rollers 34, or configured so that the continuous paper 12 is conveyable downstream in the conveyance direction by either the back feed rollers 34 or the back feed mechanism 80.

The slack detection component 78, which is connected to the control unit 76 via the bus 84 in order to configure the component for improving printing precision, can be configured by a reflection sensor disposed facing the underside of the continuous paper 12 on the conveyance path, as shown in FIG. 1. The slack detection component 78 configured by the reflection sensor is configured to detect whether or not the continuous paper 12 is slack by emitting a light beam or an ultrasound wave toward the underside of the continuous paper 12, receiving the reflected light beam or ultrasound wave, and measuring the distance to the continuous paper 12.

As shown in FIGS. 2 to 4, the slack detection component 78 may also replaced with a slack detection component 78A, which is configured by a pressure detection sensor disposed at a predetermined position on the guide plate 24 of the alignment section 22 on the conveyance path so as to contact the underside of the continuous paper 12.

The slack detection component 78A configured by the pressure detection sensor contacts the undersurface of the continuous paper 12 (glidingly contacts the continuous paper 12 while the continuous paper 12 is being conveyed), and detects the pressure working in the direction orthogonal to the surface of the guide plate 24 by the tension working on the continuous paper 12. The slack detection component 78A configured by the pressure detection sensor detects that the continuous paper 12 is slack when the pressure received from the continuous paper 12 becomes equal to or less than a predetermined threshold value.

Figure 5:
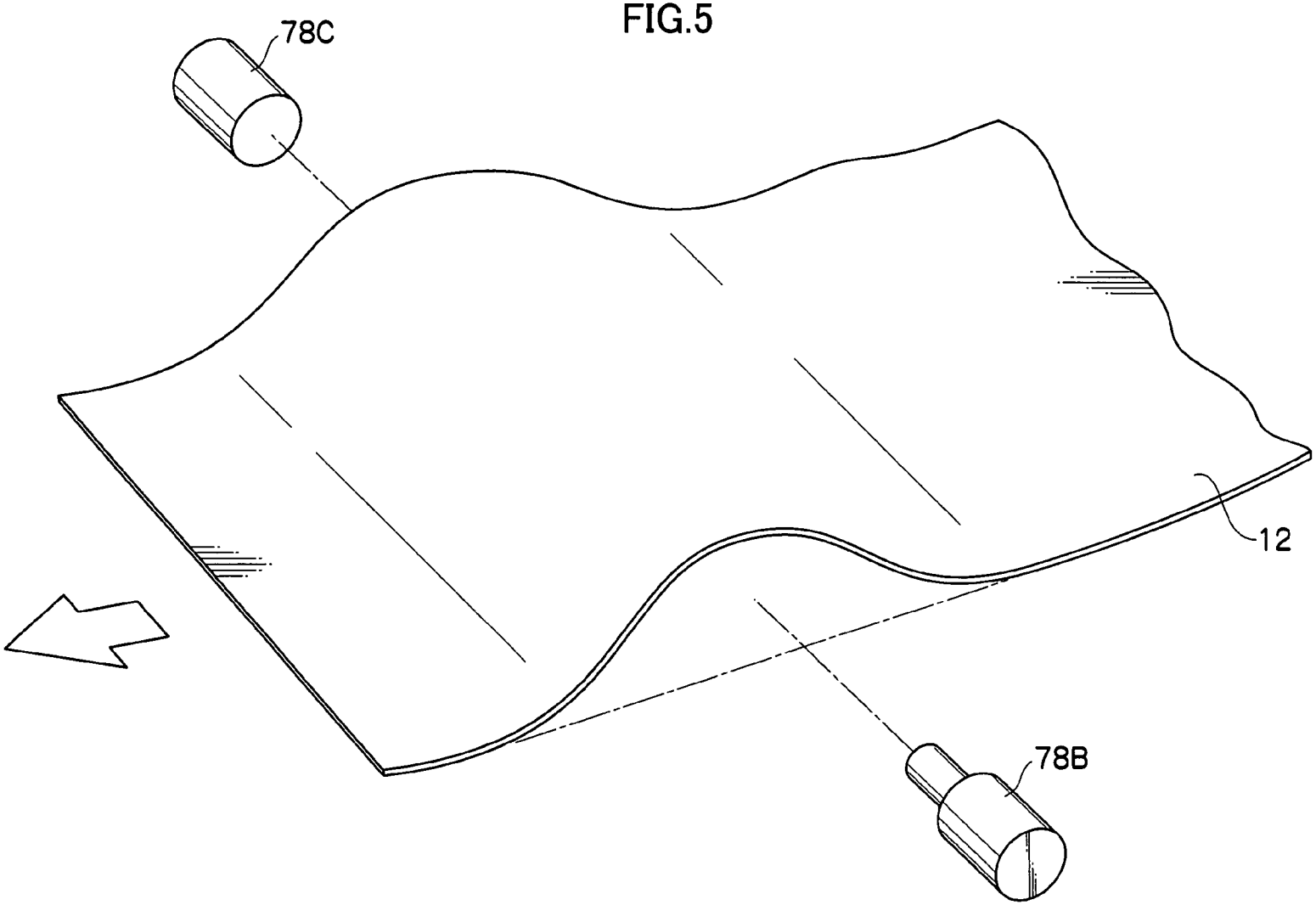
FIG. 5 is a schematic perspective view showing a slack detection component disposed in order to detect slack in the continuous paper on a conveyance path continuing to the image forming section in the image forming apparatus pertaining to the embodiment of the invention.

Moreover, as shown in FIG. 5, the slack detection component can also be configured by transmissive sensors disposed across both width-direction sides of the continuous paper 12 on the conveyance path. The slack detection component (78B, 78C) configured by the transmissive sensors is configured by combining a projector 78B, which emits a light beam or an ultrasound wave toward one side edge in the width direction of the continuous paper 12, and a receiver 78C, which receives the light beam or ultrasound wave projected from the projector 78B. The slack detection component detects that the continuous paper 12 is slack when the receiver 78C no longer receives the light beam or the ultrasound wave as a result of the slack continuous paper 12 intersecting and cutting off the path of the light beam or the ultrasound wave between the projector 78B and the receiver 78C.

As shown in FIG. 1, when printing is to be conducted in the image forming apparatus 10 with respect to the continuous paper 12, the drive rollers 20 are rotated/driven and the continuous paper 12 is conveyed on the conveyance path while tension is imparted to the continuous paper 12. In the alignment section 22, the action of the oblique roller 28 rolling contacting the continuous paper 12 causes one end edge of the continuous paper 12 to glidingly contact the edge guide 26 so that the continuous paper 12 is positioned. Then, the continuous paper 12 is conveyed between a photosensitive drum 66 in the image forming section 16 driven/controlled by the control unit 76 and a transfer unit 64 disposed facing the surface of the photosensitive drum 66, and an image is transferred. Namely, the continuous paper 12 is stably conveyed while receiving paper tension generated between the drive rollers 20 and the back feed rollers 34 or the back feed mechanism 80 serving as the tension imparting component (tension generating component), so that an image is appropriately transferred in the transfer unit 64.

The transfer unit 64 and guide members 64A disposed therein are configured to automatically separate from the photosensitive drum 66 when the continuous paper 12 is backed.

The transfer unit 64 in the image forming section 16 is configured as a transfer charger for transferring a toner image on the photosensitive drum 66 to the continuous paper 12.

The photosensitive drum 66 of the image forming section 16 comprises a drum on whose surface a photoconductor (photosensitive body) for forming an electrostatic latent image of a dot image is disposed. The photosensitive drum 66 is mounted so as to be rotated in a predetermined direction and at a constant speed by a drive motor.

Disposed around the periphery of the photosensitive drum 66 are charging devices 67 that uniformly charge the surface of the photosensitive drum 66, exposure devices 68 for irradiating the surface of the photosensitive drum 66 with an optical image to form an electrostatic latent image thereon, and a development device 70 that supplies toner, which is a material to be transferred, in order to form a toner image (image formed by the material to be transferred) corresponding to the electrostatic latent image formed on the surface of the photosensitive drum 66.

Also disposed around the periphery of the photosensitive drum 66 are a cleaning device 72, for removing toner remaining on the photosensitive drum 66, and a light neutralization device 74 that removes the charge on the photosensitive drum 66 by irradiating the photosensitive drum 66 with light.

In the image forming section 16 configured in this manner, the surface of the photosensitive drum 66 is uniformly charged (e.g., positively charged) by the charging devices 67 and irradiated with the optical image by the exposure devices 68, whereby the charge of the portion struck by the light is lost and an electrostatic latent image is formed on the surface of the photosensitive drum 66.

Next, in the image forming section 16, a magnet roll (developer roll) biased by a predetermined development voltage in the development device 70 is rotated and the positively charged toner is rubbed onto the photosensitive drum 66, whereby the toner moves onto the electrostatic latent image and a toner image is formed.

Thereafter, in the transfer section disposed with the transfer unit 64, corona discharge is conducted with an electric potential of the opposite polarity (negative) to the charge electric potential of the toner image by the transfer charger from the surface of the continuous paper 12, whereby the toner image is transferred to the continuous paper 12.

After the toner image has been transferred to the continuous paper 12, the photosensitive drum 66 is further rotated, residual toner is removed from the surface of the photosensitive drum 66 by the cleaning device 72, the surface of the photosensitive drum 66 is neutralized by the light neutralization device 74, and the photosensitive drum 66 is prepared for the formation of the next electrostatic latent image.

In the printer shown in the schematic configurable view of FIG. 1, the continuous paper 12 on which the toner image has been formed by the image forming section 16 is conveyed on the conveyance path to the flash lamp-format fixing device 18 (flash fixing device). The flash lamp-format fixing device 18 irradiates the toner image transferred to the continuous paper 12 with flash light from plural flash lamps to fix the toner image.

When an image has been formed in this manner on the continuous paper 12, the continuous paper 12 is conveyed by the drive rollers 20 to the outside of the printer.

Next, the operation of the image forming apparatus 10 will be described in a case where printing with respect to the continuous paper 12 is started, then temporarily stopped, and then resumed (including intermittent printing).

In this case, when printing with respect to the continuous paper 12 is stopped in the image forming apparatus 10, the continuous paper 12 is conveyed and overrun a certain length Y for a period of time that is necessary in order to stop it from the constant conveyance speed in view of the characteristics of the conveyance motor that drives the continuous paper 12.

Moreover, in the image forming apparatus 10, when printing is to be resumed, the continuous paper 12 is preliminarily fed a length X within a period of time that is necessary in order to bring it up to the constant conveyance speed when printing is conducted in view of the characteristics of the conveyance motor that drives the continuous paper 12.

Thus, the image forming apparatus 10 conducts control that back feeds the continuous paper 12 a distance in which a preliminary length is added as needed to the length X+Y that arises due to positional displacement of the continuous paper 12 and in which are added the length Y arising due to overrun at the stop time and the length X arising due to preliminary feeding in order to bring the continuous paper 12 up to the conveyance speed at the printing time which is a predetermined distance for ensuring that blank spaces are not created between the images when printing is resumed after printing has been temporarily stopped.

In this manner, the printed continuous paper 12 (regardless of whether the printed image has been fixed or not) is backed and placed in a standby state where the leading end of the next page of the continuous paper 12 that has not been printed is returned short of the conveyance-direction upstream side of the transfer unit 64 (e.g., one inch short). Next, when printing is to be resumed, printing is started from the leading end of the next page of the continuous paper 12 that has not been printed, whereby blank pages do not arise between the paper pages of the continuous paper 12.

Before this back feed operation begins, in the image forming apparatus 10, the angle of the oblique roller 28 is varied while (momentarily) the conveyance of the continuous paper 12 is stopped just before the back feed rollers 34 are rotated/driven by being driven/controlled by the control unit 76. The time at which the angle of the oblique roller 28 is varied may be the time in which the continuous paper 12 is stopped, but depending on the type of continuous paper 12 (e.g., thin paper), sometimes the continuous paper 12 becomes wrinkled at the portion where it is contacted by the oblique roller 28. Thus, the continuous paper 12 more closely contacts the edge guide 26 and is more stable when the time at which the angle of the oblique roller 28 is varied is the time in which the continuous paper 12 is stopped, which is optimum so that the continuous paper 12 does not become wrinkled. Rather than vary the angle of the oblique roller 28 as described above, there is also the same effect when the oblique roller 28 is caused (by a resistance reducing component) to retreat so as to separate from the continuous paper 12 when the continuous paper 12 is to be backed.

In this manner, the angle of the oblique roller 28 is set so that even if the oblique roller 28 is rotated a predetermined rotational angle and rolls over the surface of the backed continuous paper 12, the continuous paper 12 can be stably conveyed without the oblique roller 28 adversely affecting the behavior of the continuous paper 12 when the continuous paper 12 is conveyed.

Moreover, in the image forming apparatus 10, before the back feed operation begins, the guide members 64A of the transfer unit 64 are caused to retreat, so that the continuous paper 12 and the photosensitive drum 66 are no longer in contact.

Next, in the image forming apparatus 10, the back feed rollers 34 (or the back feed mechanism 80 or the back feed rollers 34 and the back feed mechanism 80) are rotated/driven a predetermined number of revolutions by the control of the control unit 76. In synchronization with this operation, the drive rollers 20 are rotated in the opposite direction of their rotational direction at the time of printing, and the continuous paper 12 is backed by a distance of a length where a preliminary length has been added as needed to the length X+Y arising to due positional displacement.

When this back feed operation is conducted by the back feed rollers 34, the back feed rollers 34 and the opposition rollers 36 rotate in a state where they apply a pinch roller load to the continuous paper 12 as the continuous paper 12 is nipped between the back feed rollers 34 and the opposition rollers 36, and they convey continuous paper 12 in the opposite direction of the direction at the time of printing. At this time, the back feed rollers 34 rotate more quickly than the paper conveyance speed of the drive rollers 20, rolling contact the continuous paper 12 while sliding on the continuous paper 12 (sliding contact), and impart tension to the continuous paper 12. At this time, it is ensured that the drive rollers 20 do not slide on the continuous paper 12, and the printing precision with respect to the continuous paper 12 is made manageable by the rotational amount of the drive rollers 20.

Next, in the image forming apparatus 10, the oblique roller 28 is returned, by being driven/controlled by the control unit 76, to its initial oblique angle position for causing the continuous paper 12 to glidingly contact the edge guide 26 so that the continuous paper 12 is positioned and conveyed for printing.

Next, when the continuous paper 12 is backed the distance of the length to which the preliminary length has been added in the image forming apparatus 10, the control unit 76 controls the motor of the drive rollers 20 to rotate/drive the drive rollers 20 and convey the continuous paper 12 the distance of the preliminary length in the conveyance direction at the time of image formation. Then, the control unit 76 stops and places the continuous paper 12 in a standby state.

In the image forming apparatus 10, when a command to resume printing is inputted while the continuous paper 12 is in the standby state as described above, the operation begins where the drive rollers 20 are driven and the continuous paper 12 is conveyed in the conveyance direction at the time of printing (the direction represented by arrow A in the drawings), the behavior of the continuous paper 12 on the conveyance path is stabilized in a skew direction (width direction of the continuous paper 12) and positioned by the action of the oblique roller 28 and the edge guide 26, and printing is conducted so that there are no useless white sheets (blank spaces) on the continuous paper 12.

When the image forming apparatus 10 is driven/controlled in this manner, the continuous paper 12 is backed and then conveyed in the conveyance direction at the time of image formation, and conveying error corresponding to the amount of play when a drive gear mechanism for the drive rollers 20, the back feed rollers 34 and the back feed mechanism 80 is reversely rotated arises due to backlash in the drive gear mechanism.

Thus, in the image forming apparatus 10, the control unit 76 drives/controls the drive rollers 20 to convey the continuous paper the distance of the preliminary length in the conveyance direction at the time of image formation after the back feeding, and stops and places the continuous paper 12 in a standby state. Thus, the operation can be started without error arising in a state where the play of the drive gear mechanism resulting from backlash when the conveyance of the continuous paper 12 for image formation is next to be resumed has been removed, and the printing precision of the printing leading end position on the continuous paper 12 when printing is to be started by the transfer unit 64 with respect to the continuous paper 12 can be improved.

When the continuous paper 12 is backed in the image forming apparatus 10 the distance of the length X+Y arising due to positional displacement, a method may be implemented to eliminate error arising due to backlash when starting the operation of conveyance the continuous paper 12 in the conveyance direction (direction represented by arrow A in the drawings) reversed from the back feed direction.

Next, a detailed example of the control operation pertaining to preprocessing at the printing start time conducted by the control unit 76 serving as the component for improving printing precision when printing is started by the image forming section 16, which is a printing unit (transfer unit), with respect to the continuous paper 12, which is a continuous recording medium in which pin holes are not formed, will be described with reference to the flowchart of FIG. 7.

Figure 7:
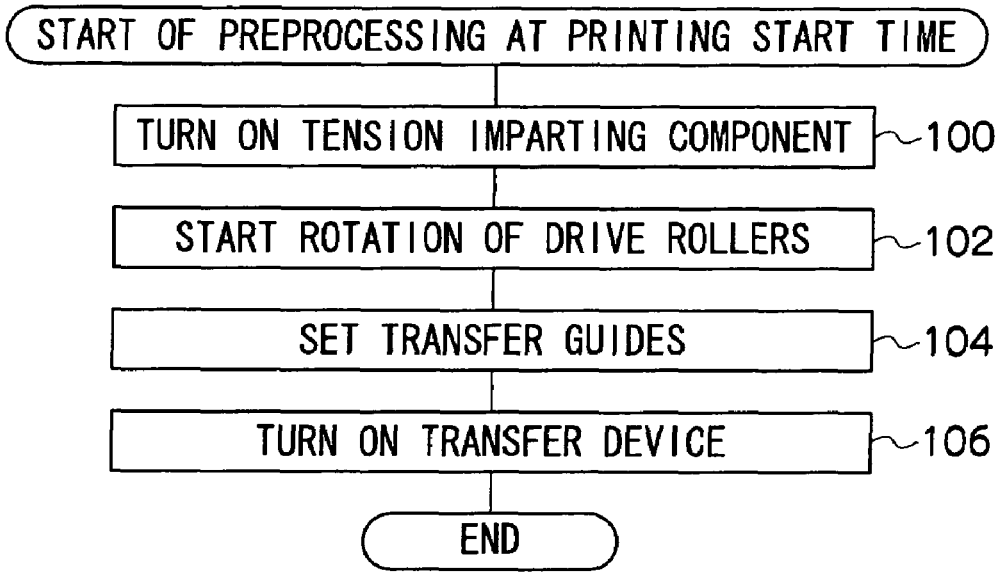
FIG. 7 is a flowchart for describing a detailed example of a control operation relating to preprocessing at a printing start time pertaining to the component for improving printing precision in the image forming apparatus pertaining to the embodiment of the invention.

The preprocessing at the printing start time shown in the flowchart of FIG. 7 is conducted as interrupt processing with respect to the ordinary printing of the image forming apparatus 10. Here, processing is conducted which starts when a command to start printing is inputted to the operational input component 82 in the standby state where printing has been interrupted by the image forming apparatus 10, the continuous paper 12 has been backed the distance of the length to which the preliminary length has been added, the continuous paper 12 has been conveyed the distance of the preliminary length in the conveyance direction at the time of image formation, and the continuous paper 12 has been stopped. In step 100, the tension imparting component is turned ON. In turning ON the tension imparting component, the back feed rollers 34 (or the back feed mechanism 80 or the back feed rollers 34 and the back feed mechanism 80) are rotated in a rotational direction where the back feed rollers 34 feed the continuous paper 12 in the opposite direction of the conveyance direction, and tension is imparted to the continuous paper 12. Then, the processing proceeds to step 102.

In step 102, the drive rollers 20 are rotated/driven in the conveyance direction at the time of printing, and the conveyance of the continuous paper 12 starts. Then, the processing proceeds to step 104.

In step 104, a motor mechanism for operating the guide members is driven/operated, whereby the guide members 64A in the transfer unit 64 are set in a transfer state for pressing the continuous paper 12 against the photosensitive drum 66 to conduct printing. Then, the processing proceeds to step 106.

In step 106, electrical power is supplied to the transfer unit 64, a transfer device is turned ON, the transfer operation is started, and the preprocessing at the printing start time ends. After the preprocessing at the printing start time, the control unit 76 executes ordinary printing control and conducts printing on the continuous paper 12.

Next, a detailed example of the control operation pertaining to post-processing at the printing end time conducted by the control unit 76 serving as the component for improving printing precision when printing is stopped by the image forming section 16, which is a printing unit (transfer unit), with respect to the continuous paper 12, which is a continuous recording medium in which pin holes are not formed, will be described with reference to the flowchart of FIG. 8.

Figure 8:
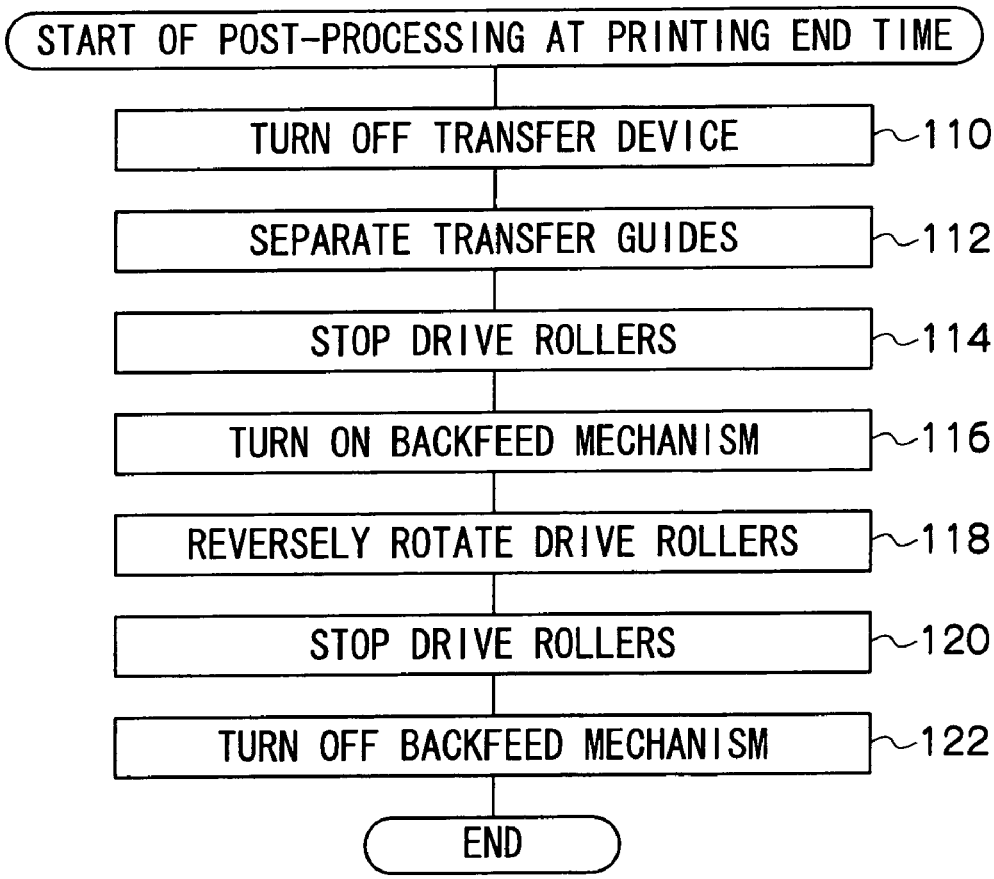
FIG. 8 is a flowchart for describing a detailed example of a control operation relating to post-processing at a printing end time pertaining to the component for improving printing precision in the image forming apparatus pertaining to the embodiment of the invention.

The post-processing at the printing end time shown in the flowchart of FIG. 8 is conducted as interrupt processing with respect to the ordinary printing of the image forming apparatus 10. Here, processing is conducted which starts when a command to stop printing is inputted from the operational input component 82 while printing is being conducted by the image forming apparatus 10. In step 110, the transfer device of the transfer unit 64 is turned OFF. In turning OFF the transfer device, the supply of electrical power to the transfer unit 64 is stopped to stop the transfer operation. Then, the processing proceeds to step 112.

In step 112, the motor mechanism is driven/operated, whereby the guide members 64A in the transfer unit 64 separate from the photosensitive drum 66. Then, the processing proceeds to step 114.

In step 114, the rotation of the drive rollers 20 is stopped and the conveyance of the continuous paper 12 is stopped. Then, the processing proceeds to step 116.

In step 116, the back feed mechanism is turned ON. In turning ON the back feed mechanism, the back feed rollers 34 (or the back feed mechanism 80 or the back feed rollers 34 and the back feed mechanism 80) are placed in a backpedaled state where they can be rotated in a rotational direction where the back feed rollers 34 feed the continuous paper 12 in the opposite direction of the conveyance direction and idle while sliding on the continuous paper 12. Then, the processing proceeds to step 118.

In step 118, the drive rollers 20 are reversely rotated (rotated to convey the continuous paper 12 in the opposite direction of the conveyance direction at the time of printing). Then, the processing proceeds to step 120.

In step 120, the drive rollers 20 are rotated a predetermined number of revolutions to back feed the continuous paper 12 a predetermined distance, and then the drive rollers 20 are stopped. Then, the processing proceeds to step 122.

In step 122, processing is conducted to turn OFF the back feed rollers 34 (or the back feed mechanism 80 or the back feed rollers 34 and the back feed mechanism 80) serving as the tension imparting component. Then, the post-processing at the printing end time ends.

In step 122, processing may also be conducted which turns OFF the back feed rollers 34 (or the back feed mechanism 80 or the back feed rollers 34 and the back feed mechanism 80) serving as the tension imparting component, excites and stops the motor for rotating/driving the back feed rollers 34 or the back feed mechanism 80, stops the reverse rotation of the back feed rollers 34, and maintains the tension in the continuous paper 12 to prevent the continuous paper 12 from becoming slack.

Figure 9:
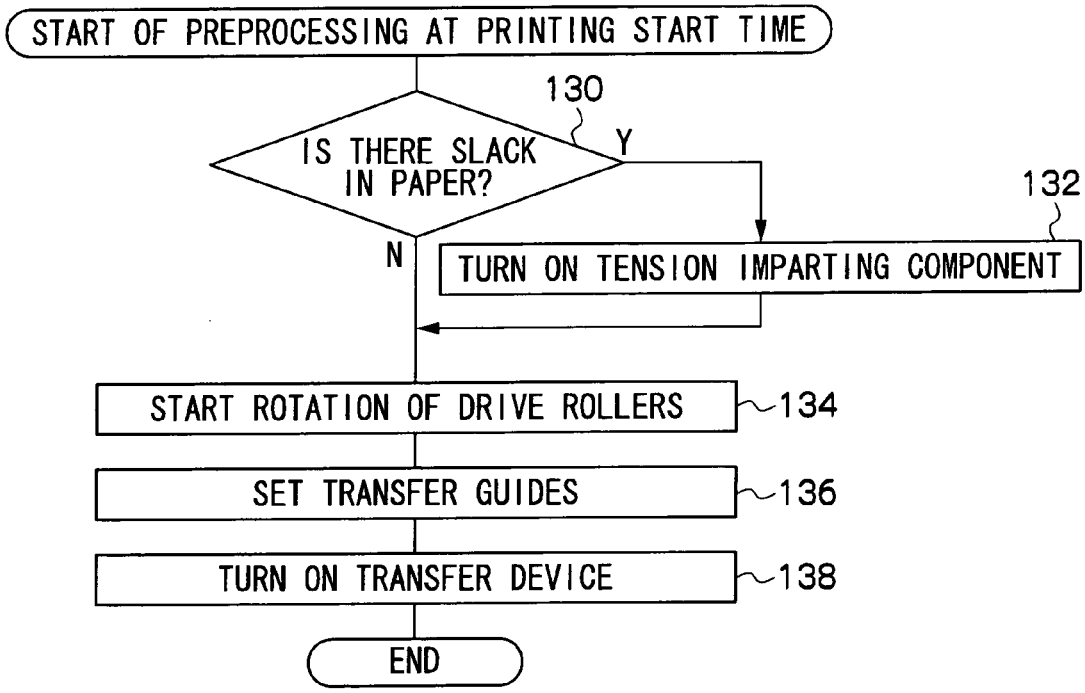
FIG. 9 is a flowchart for describing another detailed example of the control operation relating to preprocessing at the printing start time pertaining to the component for improving printing precision in the image forming apparatus pertaining to the embodiment of the invention.

Next, another detailed example of the control operation pertaining to the preprocessing at the printing start time conducted by the control unit 76 serving as the component for improving printing precision will be described with reference to the flowchart of FIG. 9.

The preprocessing at the printing start time shown in the flowchart of FIG. 7 is conducted as interrupt processing with respect to the ordinary printing of the image forming apparatus 10. Here, processing is conducted which starts when a command to start printing is inputted to the operational input component 82 in the standby state where printing has been interrupted by the image forming apparatus 10, the continuous paper 12 has been backed the distance of the length to which the preliminary length has been added, the continuous paper 12 has been conveyed the distance of the preliminary length in the conveyance direction at the time of image formation, and the continuous paper 12 has been stopped. In step 130, it is determined whether or not there is slack in the continuous paper 12. The processing that determines whether there is slack in the continuous paper 12 moves to step 132 when the control unit 76 determines, on the basis of the detection result of the slack detection component 78, that there is slack in the continuous paper 12.

In step 132, the tension imparting component is turned ON. In turning ON the tension imparting component, the back feed rollers 34 (or the back feed mechanism 80 or the back feed rollers 34 and the back feed mechanism 80) are rotated in a rotational direction where they feed the continuous paper 12 in the opposite direction of the conveyance direction, and tension is imparted to the continuous paper 12. Then, the processing proceeds to step 134.

The processing that determines whether there is slack in the continuous paper 12 moves to step 134 when the control unit 76 determines, on the basis of the detection result of the slack detection component 78, that there is no slack in the continuous paper 12.

In step 134, the drive rollers 20 are rotated/driven in the conveyance direction at the time of printing, and the conveyance of the continuous paper 12 starts. Then, the processing proceeds to step 136.

In step 136, the motor mechanism for operating the guide members is driven/operated, whereby the guide members 64A in the transfer unit 64 are set in the transfer state. Then, the processing proceeds to step 138.

In step 138, electrical power is supplied to the transfer unit 64, the transfer device is turned ON, the transfer operation is started, and the preprocessing at the printing start time ends. After the preprocessing at the printing start time, the control unit 76 executes ordinary printing control and conducts printing on the continuous paper 12.

Next, another detailed example of the control operation pertaining to the post-processing at the printing end time conducted by the control unit 76 serving as the component for improving printing precision when printing with respect to the continuous paper 12 is stopped will be described with reference to the flowchart of FIG. 10.

Figure 10:
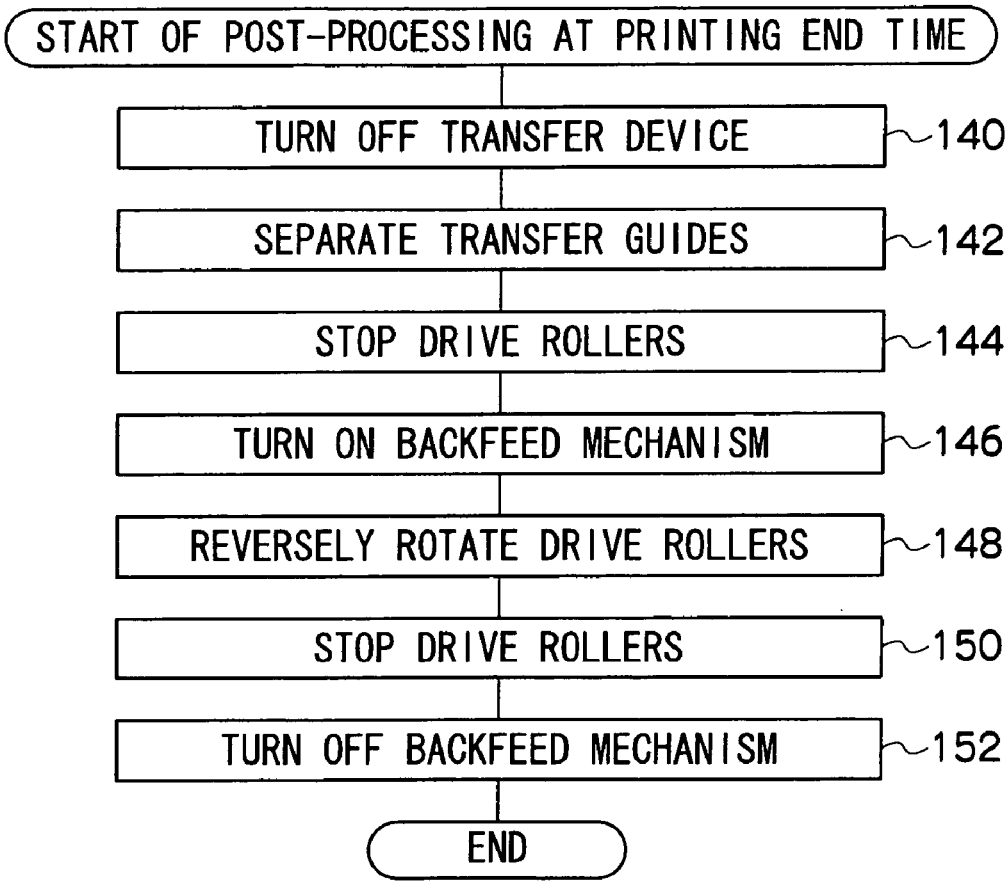
FIG. 10 is a flowchart for describing another detailed example of the control operation relating to post-processing at the printing end time pertaining to the component for improving printing precision in the image forming apparatus pertaining to the embodiment of the invention.

The post-processing at the printing end time shown in the flowchart of FIG. 10 is conducted as interrupt processing with respect to the ordinary printing of the image forming apparatus 10. Here, processing is conducted which starts when a command to stop printing is inputted from the operational input component 82 while printing is being conducted by the image forming apparatus 10. In step 140, the transfer device of the transfer unit 64 is turned OFF. In turning OFF the transfer device, the supply of electrical power to the transfer unit 64 is stopped to stop the transfer operation. Then, the processing proceeds to step 142.

In step 142, the motor mechanism is driven/operated, whereby the guide members 64A in the transfer unit 64 separate from the photosensitive drum 66. Then, the processing proceeds to step 144.

In step 144, the rotation of the drive rollers 20 is stopped and the conveyance of the continuous paper 12 is stopped. Then, the processing proceeds to step 146.

In step 146, the back feed mechanism is turned ON. In turning ON the back feed mechanism, the back feed rollers 34 (or the back feed mechanism 80 or the back feed rollers 34 and the back feed mechanism 80) are placed in a backpedaled state where they can be rotated in a rotational direction where the back feed rollers 34 feed the continuous paper 12 in the opposite direction of the conveyance direction and idle while sliding on the continuous paper 12. Then, the processing proceeds to step 148.

In step 148, the drive rollers 20 are reversely rotated (rotated to convey the continuous paper 12 in the opposite direction of the conveyance direction at the time of printing). Then, the processing proceeds to step 150.

In step 150, the drive rollers 20 are rotated a predetermined number of revolutions to back feed the continuous paper 12 a predetermined distance, and then the drive rollers 20 are stopped. Then, the processing proceeds to step 152.

In step 152, processing is conducted to turn OFF the back feed rollers 34 (or the back feed mechanism 80 or the back feed rollers 34 and the back feed mechanism 80) serving as the tension imparting component. Then, the post-processing at the printing end time ends.

In step 152, processing may also be conducted which turns OFF the back feed rollers 34 (or the back feed mechanism 80 or the back feed rollers 34 and the back feed mechanism 80) serving as the tension imparting component, excites and stops the motor for rotating/driving the back feed rollers 34 or the back feed mechanism 80, stops the reverse rotation of the back feed rollers 34, and maintains the tension in the continuous paper 12 to prevent the continuous paper 12 from becoming slack. Moreover, the control unit 76 may conduct control so that the operation of exciting and stopping the motor for rotating/driving the back feed rollers 34 or the back feed mechanism 80 is omitted when the slack detection component 78 determines that there is no slack in the continuous paper 12.

Next, yet another detailed example of the control operation pertaining to the preprocessing at the printing start time conducted by the control unit 76 serving as the component for improving printing precision will be described with reference to the flowchart of FIG. 11.

Figure 11:
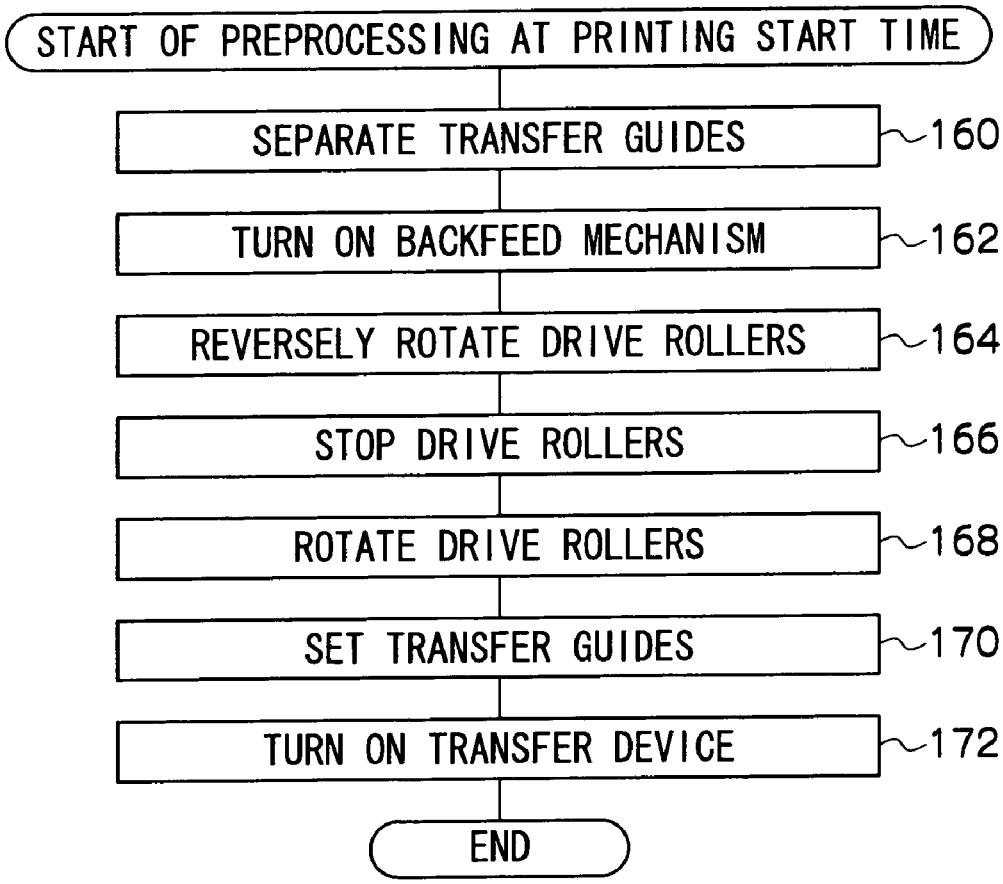
FIG. 11 is a flowchart for describing yet another detailed example of the control operation relating to preprocessing at the printing start time pertaining to the component for improving printing precision in the image forming apparatus pertaining to the embodiment of the invention.

The preprocessing at the printing start time shown in the flowchart of FIG. 11 is conducted as interrupt processing with respect to the ordinary printing of the image forming apparatus 10. Here, processing is conducted which starts when a command to start printing is inputted to the operational input component 82 after printing has been stopped by the image forming apparatus 10. In step 160, the motor mechanism for operating the guide members is driven/operated, whereby the guide members 64A of the transfer unit 64 are separated from the photosensitive drum 66. Then, the processing proceeds to step 162.

In step 162, the back feed mechanism is turned ON. In turning ON the back feed mechanism, the back feed rollers 34 (or the back feed mechanism 80 or the back feed rollers 34 and the back feed mechanism 80) are placed in a backpedaled state where they can be rotated in a rotational direction where the back feed rollers 34 feed the continuous paper 12 in the opposite direction of the conveyance direction and idle while sliding on the continuous paper 12. Then, the processing proceeds to step 134.

In step 164, the drive rollers 20 are reversely rotated (rotated to convey the continuous paper 12 in the opposite direction of the conveyance direction at the time of printing). Then, the processing proceeds to step 166.

In step 166, the drive rollers 20 are reversely rotated a predetermined number of revolutions to back feed the continuous paper 12 a predetermined distance, and then the drive rollers 20 are stopped. Then, the processing proceeds to step 168.

In step 168, the drive rollers 20 are rotated a predetermined number of revolutions to convey the continuous paper 12 a predetermined distance in the conveyance direction A at the time of printing, and then the drive rollers 20 are stopped. Then, the processing proceeds to step 170.

In step 170, the motor mechanism for operating the guide members is driven/operated, whereby the guide members 64A of the transfer unit 64 are set in the transfer state. Then, the processing proceeds to step 172.

In step 172, electrical power is supplied to the transfer unit 64, the transfer device is turned ON, the transfer operation is started, and the preprocessing at the printing start time ends. After the preprocessing at the printing start time, the control unit 76 executes ordinary printing control and conducts printing on the continuous paper 12.

Next, yet another detailed example of the control operation pertaining to the post-processing at the printing end time conducted by the control unit 76 serving as the component for improving printing precision when printing with respect to the continuous paper 12 is stopped will be described with reference to the flowchart of FIG. 12.

Figure 12:
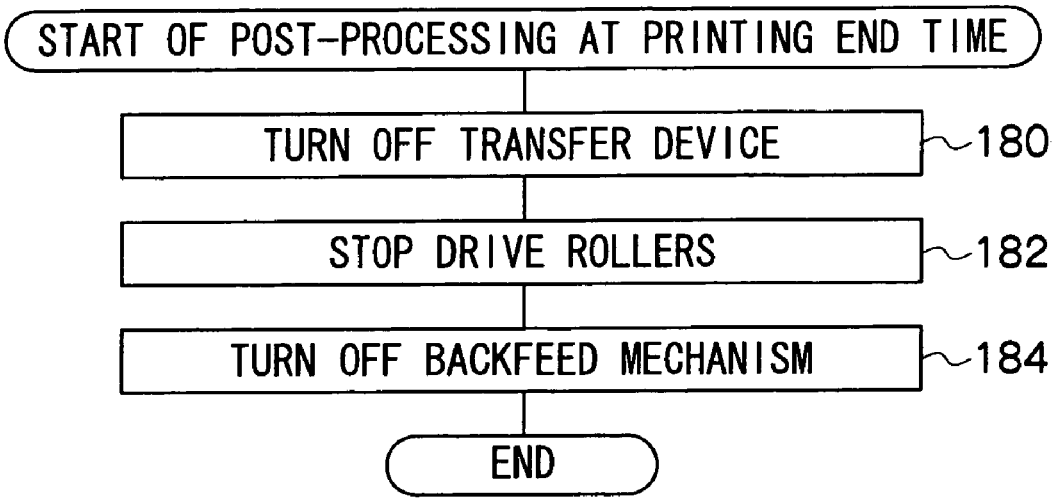
FIG. 12 is a flowchart for describing yet another detailed example of the control operation relating to post-processing at the printing end time pertaining to the component for improving printing precision in the image forming apparatus pertaining to the embodiment of the invention.

The post-processing at the printing end time shown in the flowchart of FIG. 12 is conducted as interrupt processing with respect to the ordinary printing of the image forming apparatus 10. Here, processing is conducted which starts when a command to stop printing is inputted from the operational input component 82 while printing is being conducted by the image forming apparatus 10. In step 180, the transfer device of the transfer unit 64 is turned OFF. In turning OFF the transfer device, the supply of electrical power to the transfer unit 64 is stopped to stop the transfer operation. Then, the processing proceeds to step 182.

In step 182, the drive rollers 20 are immediately stopped. Then, the processing proceeds to step 184.

In step 184, processing is conducted which turns OFF the back feed rollers 34 (or the back feed mechanism 80 or the back feed rollers 34 and the back feed mechanism 80) serving as the tension imparting component. Then, the post-processing at the printing end time ends.

In step 184, processing may also be conducted which turns OFF the back feed rollers 34 (or the back feed mechanism 80 or the back feed rollers 34 and the back feed mechanism 80) serving as the tension imparting component, excites and stops the motor for rotating/driving the back feed rollers 34 or the back feed mechanism 80, stops the reverse rotation of the back feed rollers 34, and maintains the tension in the continuous paper 12 to prevent the continuous paper 12 from becoming slack. Moreover, the control unit 76 may conduct control so that the operation of exciting and stopping the motor for rotating/driving the back feed rollers 34 or the back feed mechanism 80 is omitted when the slack detection component 78 detects that there is no slack in the continuous paper 12.

In the image forming apparatus 10 configured so that the continuous paper 12 is not backed when printing of the continuous paper 12 is resumed after being temporarily stopped, the continuous paper 12 is stopped and then conveyance is continued from the stopped state. When printing is resumed, the tension imparting component in the component for improving printing precision imparts tension to the continuous paper 12 so that the tension in the continuous paper 12 is close to that at the time of printing. Thus, the conveyance of the paper at the time of printing can be stabilized, and the printing precision at the time printing is resumed can be improved.

The present invention is not limited to the preceding embodiment and can be configured in various other ways in a range that does not depart from the gist of the invention.

An image forming apparatus of a first aspect of the invention forms an image on a long band-like sheet-like recording medium when passing the recording medium through an image forming section while conveying the recording medium on a conveyance path, the image forming apparatus comprising: a recording medium drive component that is disposed downstream of the image forming section in a conveyance direction on the conveyance path and conducts an operation that conveys the recording medium; a tension imparting component that is disposed upstream of the image forming section in the conveyance direction on the conveyance path and imparts tension for taking up slack in the recording medium; and a control unit which, when a printing operation for forming an image is started, drives the tension imparting component to impart tension to the recording medium between the recording medium drive component and the tension imparting component, starts the recording medium conveyance operation, and controls the image forming section to form an image in a state where the recording medium is stably conveyed.

The image forming apparatus of the first aspect may be configured so that when the printing operation for forming an image is stopped, the control unit restrains the tension imparting component to maintain tension in the recording medium so that the recording medium is prevented from becoming slack.

By configuring the image forming apparatus in this manner, in addition to the action and effects of the invention of the first aspect, the control unit restrains the tension imparting component so that the rollers of the tension imparting component do not rotate until printing is resumed after printing has ended in the image forming apparatus, whereby the recording medium on the conveyance path can be prevented from becoming slack.

The image forming apparatus of the first aspect may further comprise an alignment section that is disposed at a position between the image forming section and the tension imparting component on the conveyance path and is for aligning the recording medium in a width direction of the recording medium.

By configuring the image forming apparatus in this manner, the tension imparting component is disposed upstream of the alignment section in the conveyance direction of the recording medium. Thus, in addition to the action and effects of the invention of the first aspect, the recording medium is properly positioned by the action of the alignment section and conveyed into the image forming section, so that an appropriate image can be formed on the recording medium. Namely, the recording medium can be prevented from being conveyed into the image forming section in a state where the position of the recording medium is displaced due to a disturbance resulting from the tension imparting component rolling contacting the recording medium, so that an appropriate image can be formed on the recording medium.

The image forming apparatus of the first aspect may further comprise a slack detection component that detects slack in the recording medium on the conveyance path, wherein when the printing operation for forming an image is started, the control unit conducts control that drives the tension imparting component to impart tension to the recording medium between the recording medium drive component and the tension imparting component when the slack detection component detects slack in the recording medium.

By configuring the image forming apparatus in this manner, an operation is conducted which imparts tension to the recording medium to take up the slack in the recording medium only when there is slack in the recording medium on the conveyance path. Thus, in addition to the action and effects of the invention of the first aspect, the printing operation can be conducted rationally without waste and quickened when the recording medium is not slack.

The image forming apparatus of the first aspect may be configured so that before the printing operation for forming an image is started, the control unit conducts a back feed operation that causes the recording medium on the conveyance path to be conveyed, in the opposite direction of the conveyance direction for image formation, a predetermined distance for ensuring that blank spaces are not created between images, and then conducts control that drives the tension imparting component to impart tension to the recording medium between the recording medium drive component and the tension imparting component.

By configuring the image forming apparatus in this manner, in addition to the action and effects of the invention of the first aspect, image can be formed without creating blank spaces in a series of images formed on the recording medium, and it can be ensured that useless blank spaces are not created on the recording medium.

In the image forming apparatus of the first aspect, the tension imparting component may be configured to double as a back feed mechanism for conducting a back feed operation that causes the recording medium on the conveyance path to be conveyed, in the opposite direction of the conveyance direction for image formation, a predetermined distance for ensuring that blank spaces are not created between images.

By configuring the image forming apparatus in this manner, the tension imparting component and the back feed mechanism having the same function can be integrated, so that in addition to the action and effects of the invention of the first aspect, the configuration of the apparatus can be simplified and a product can be provided inexpensively.

The image forming apparatus of the first aspect may be configured so that the control unit conducts a back feed operation that causes the recording medium on the conveyance path to be conveyed, in the opposite direction of the conveyance direction for image formation, a predetermined distance for ensuring that blank spaces are not created between images, causes the recording medium to be stopped and placed in a standby state after the recording medium has been conveyed in the range of a preliminary length in the conveyance direction for image formation, and before the printing operation for forming an image is started, drives the tension imparting component to impart tension to the recording medium between the recording medium drive component and the tension imparting component.

By configuring the image forming apparatus in this manner, the recording medium is backed and then stopped and placed in a standby state after the recording medium has been conveyed the distance of the preliminary length in the conveyance direction for image formation. Next, the operation can be started without error arising in a state where the play of the drive gear mechanism resulting from backlash when the conveyance of the recording medium is resumed for image formation has been removed. Thus, in addition to the action and effects of the invention of the first aspect, the precision of the printing lead position on the recording medium when starting printing in the image forming section with respect to the recording medium can be improved, whereby an appropriate image can be formed on the recording medium.

What is claimed is:

1. An image forming apparatus that conveys a long belt-like recording sheet on a conveyance path and forms an image on the recording sheet when the recording sheet passes through an image forming section, the image forming apparatus comprising:

a recording medium drive component that is disposed downstream of the image forming section in a conveyance direction on the conveyance path and conveys the recording medium;

a tension imparting component that is disposed upstream of the image forming section in the conveyance direction on the conveyance path and imparts tension to the recording medium; and a control unit which, when a printing operation for forming an image is started, drives the tension imparting component to impart tension to the recording medium between the recording medium drive component and the tension imparting component, and starts the recording medium conveyance operation after imparting the tension.

2. The image forming apparatus of claim 1, wherein, when the printing operation for forming an image is stopped, the control unit restrains the tension imparting component to maintain tension in the recording medium.

3. The image forming apparatus of claim 1, further comprising an alignment section for aligning the recording medium in a width direction of the recording medium, the alignment section being disposed at a position between the image forming section and the tension imparting component on the conveyance path.

4. The image forming apparatus of claim 1, further comprising a slack detection component that detects slack in the recording medium on the conveyance path, wherein, when the printing operation for forming an image is started, the control unit drives the tension imparting component to impart tension to the recording medium between the recording medium drive component and the tension imparting component in case of the slack detection component detecting slack in the recording medium.

5. The image forming apparatus of claim 1, wherein, before the printing operation for forming an image is started, the control unit backfeeds the recording medium in the opposite direction of the conveyance direction on the conveyance path, and drives the tension imparting component to impart tension to the recording medium between the recording medium drive component and the tension imparting component.

6. The image forming apparatus of claim 1, wherein the tension imparting component backfeeds the recording medium on the conveyance path in the opposite direction of the conveyance direction.

7. The image forming apparatus of claim 1, wherein the control unit backfeeds the recording medium on the conveyance path in the opposite direction of the conveyance direction, and stops the recording medium in a standby state, and before the printing operation for forming an image is started, the control unit drives the tension imparting component to impart tension to the recording medium between the recording medium drive component and the tension imparting component.

8. A method of forming an image on a long band-like sheet-like recording medium using an image forming apparatus, the image forming apparatus including an image forming section that forms an image on the recording medium, a recording medium drive component that is disposed downstream of the image forming section and conveys the recording medium, a tension imparting component that is disposed upstream of the image forming section and imparts tension to the recording medium, the image forming method comprising:

a tension imparting step to impart tension to the recording medium between the recording medium drive component and the tension imparting component by the tension imparting component when the image forming section starts forming the image on the recording medium; and conveying step to convey the recording medium after imparting the tension.

9. The image forming method of claim 8, further comprising the tension restraining step that restrains the tension imparting component when the image forming section stops forming the image on the recording medium.

10. The image forming method of claim 8, wherein the image forming apparatus further includes a slack detection component that detects slack in the recording medium, and the tension imparting step is performed in case that the slack detection component detects slack in the recording medium when the image forming section starts forming the image on the recording medium.

11. The image forming method of claim 8, further comprising a backfeeding step that backfeeds the recording medium in the opposite direction of the conveyance direction before the tension imparting step.

12. The image forming method of claim 8, further comprising a backfeeding step that backfeeds the recording medium in the opposite direction of the conveyance direction, a conveying step that conveys the recording medium in the conveyance direction to a standby state before the tension imparting step.

* * * * *